US006718904B2

(12) United States Patent
Degenkamp

(10) Patent No.: US 6,718,904 B2
(45) **Date of Patent: *Apr. 13, 2004**

(54) ANCHOR FLUKE

(75) Inventor: Gijsbertus Degenkamp, Voorburg (NL)

(73) Assignee: Vrijhof Ankers Beheer B.V. (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/976,355

(22) Filed: Nov. 21, 1997

(65) Prior Publication Data

US 2003/0140839 A1 Jul. 31, 2003

Related U.S. Application Data

(63) Continuation of application No. PCT/NL96/00242, filed on Jun. 14, 1996.

(30) Foreign Application Priority Data

Jun. 16, 1995 (NL) ..... 1000538

(51) Int. Cl.[7] ..... B63B 21/32
(52) U.S. Cl. ..... 114/301
(58) Field of Search ..... 114/301–306, 294

(56) References Cited

U.S. PATENT DOCUMENTS

| | | | | |
|---|---|---|---|---|
| 3,777,695 A | | 12/1973 | Bruce | |
| 4,397,256 A | | 8/1983 | Bruce | |
| 4,706,595 A | | 11/1987 | van den Haack | |
| 4,781,142 A | * | 11/1988 | Cheung | 114/301 |
| 4,802,434 A | * | 2/1989 | Bruce | 114/301 |
| 4,856,451 A | * | 8/1989 | Bruce | 114/301 |

FOREIGN PATENT DOCUMENTS

| | | | | |
|---|---|---|---|---|
| EP | 0220758 | | 5/1987 | |
| EP | 0596157 | | 5/1994 | |
| GB | 2091188 | * | 7/1982 | 114/301 |
| GB | 2171970 | * | 9/1986 | 114/301 |
| WO | 9412386 | | 6/1994 | |

* cited by examiner

*Primary Examiner*—Ed Swinehart
(74) *Attorney, Agent, or Firm*—Williams, Morgan & Amerson

(57) ABSTRACT

Anchor fluke (1) having a hollow plate-shaped body adapted for attachment to a shank and/or anchor lines, with a longitudinal axis and a front penetration edge (3) and a rear trailing edge (4), which are located at a distance from one another in the direction of the longitudinal axis, wherein the fluke has a plane of symmetry that contains the longitudinal axis and is substantially perpendicular to the plate-shaped body. The hollow plate-shaped body has an upper surface (2*a*) with a centre of gravity and a lower surface (2*b*) which surfaces are bounded by the penetration edge, the trailing edge and lateral edges (5*a*, 5*b*) and wherein the body, at the lower surface, substantially between the edges, is provided with surfaces for counteracting a rolling movement about the longitudinal axis during penetration of the anchor fluke in an anchorage ground, and with vertical trailing edges (13*a*, 13*b*) for counteracting a yawing movement about an axis that is perpendicular to the longitudinal axis and is located in the plane of symmetry during the penetration in an anchorage ground.

49 Claims, 4 Drawing Sheets

ANCHOR FLUKE

This is a continuation of application No. PCT/NL96/00242, filed Jun. 14, 1996.

FIELD OF THE INVENTION

The invention relates to an anchor fluke. An anchor fluke forms that part of an anchor that has to produce the holding (counter) force necessary for the anchorage of an object. The anchor fluke is provided with means for attachment at the lower end of an anchor shank, which may have a rigid (plates) or flexible (cables, chains) construction and, at its upper end, is provided with means for attachment to the lower end of a penetration or anchor line, with which the anchor fluke can be drawn into the anchorage ground and be connected to the object that has to be anchored.

BACKGROUND AND PRIOR ART

After having been lowered, the position taken up by the anchor fluke on the ground will not always be optimal for penetration into the anchorage ground. This may be the result of an asymmetric landing of the anchor fluke or an asymmetrically shaped basis (irregularities). Then, when the penetration line is hauled in, the anchor fluke will penetrate into the ground in an oblique manner, as viewed about the longitudinal axis or about an axis perpendicular to the fluke. In order to effectuate that the anchor fluke arrives back on course again and does not continue moving according to a penetration path that forms an angle with the penetration line, lateral forces on the anchor fluke will have to be generated. An oblique orientation may also be the result of areas in the anchorage ground having a different packaging density or composition. In that case, lateral forces must also be produced to restore the orientation of the anchor fluke.

During the initial penetration into the anchorage ground as well as during the further course of the penetration into said ground, it is therefore desirable to have the disposal of means with which said lateral, correcting forces are produced. To this end, many types of anchors and anchor flukes are equipped with stabilizers that correct a rolling and/or yawing movement of the anchor fluke.

A first example hereof is the anchor shown in U.S. Pat. No. 3,964,421 in the name of Van den Haak, wherein the substantially triangular flat fluke is provided with stabilizer plates at the rear edge at the corners, which stabilizer plates partially project sideways and of which the normal on the front planes is directed upwards to the front.

From European patent 49455 in the name of Van den Haak an anchor is known that, near the rear edge at the corners, is provided with stabilizer plates that project upwards and have front planes of which the normal is directed to the front and downwards, wherein the normals of the front planes of the stabilizer plates provided on either side are possibly facing away from one another.

From British patent 1,356,259 and European patent 0,020,152 an anchor is known, the fluke of which is a concavely bent, substantially triangular plate that, at its lateral edges, merges into concave, upwardly projecting tapering lateral plates, which form stabilizer surfaces that lie in a circular conoid converging backwards.

In WO 87/01347 a further development of the above anchor is described, in which the sides of the flat fluke are provided with lateral portions standing obliquely upright, onto which again substantially upright lateral plates are attached. Auxiliary flukes are transversely attached to said lateral plates, either on the outside or on the inside, which auxiliary flukes may serve as stabilizers. These stabilizer plates have front planes directed obliquely forwards and downwards.

Finally, from U.S. Pat. No. 4,433,635 an anchor is known, the fluke of which, at its rear end, merges into a stabilizer plate extending rearwards and sideways, which stabilizer plate inclines forwards and upwards with respect to the fluke.

All the discussed and known anchors are provided with stabilizer means or plates that may be considered to be extra parts with respect to the actual fluke or as projecting parts thereof. This will cause production costs of the anchors in question to rise. However, it is possibly more important that the protruding parts form objects that are easily damaged or may easily cause damage to other objects and have an unfavourable influence on penetration.

It is therefore an object of the present invention to provide an anchor fluke that corrects orientation and course with the least possible additions to the actual fluke and moreover shows improved penetration performance and has increased holding force.

To this end the invention provides an anchor fluke comprising a hollowe plate-shaped body, with attachment means for a shank and/or anchor lines, with a longitudinal axis and a front penetration edge and a rear trailing edge, which are located at a distance from one another in the direction of the longitudinal axis, wherein the fluke has a plane of symmetry that contains the longitudinal axis and is substantially perpendicular to the plate-shaped body, wherein the hollow plate-shaped body comprises an upper surface with a surface centre of gravity an a lower surface, which surfaces are bounded by the penetration edge, the trailing edge and lateral edges, and wherein said body, at the lower side, substantially between the edges, is provided with means for counteracting a rolling movement about the longitudinal axis during penetration of the anchor fluke in an anchorage ground and with means for counteracting a yawing movement about an axis that is perpendicular to the longitudinal axis and is located in the plane of symmetry during penetration in an anchorage ground.

In the anchor fluke according to the invention, the means for counteracting a rolling movement and a yawing movement are located on the lower side, at least substantially within the circumference of the actual fluke, while, during penetration, the ground can move freely across the upper surface of the fluke and the other penetration properties of the anchor fluke are therefore enhanced. The upper surface of the fluke is then at least almost fully available for providing holding force in cooperation with the ground.

The means for counteracting the rolling movement is preferably formed at least partially by planes of the lower surface of the fluke.

In that case the planes, viewed in longitudinal direction, preferably comprise first lateral areas of the lower surface of the fluke, which are located substantially behind the centre of gravity of the fluke, with surfaces that face downwards and forwards and possibly face one another. As a result of this arrangement, the form of the fluke is kept simple and the orientation of the fluke for penetration and during penetration is favourably influenced, since the means for counteracting the rolling and yawing movement keep the rear side of the fluke up and contribute to a foil-shape of the fluke.

The wing-shape of the fluke is further enhanced by second lateral areas at the lower surface of the fluke, located in front of the first lateral areas as seen in longitudinal direction, the second lateral areas having surfaces that face rearwards and downwards.

These surfaces, too, preferably face one another.

The anchor fluke is furthermore preferably provided with substantially vertical trailing plates that are located between the first lateral areas and the trailing edge and may form an integral part of the main longitudinal girders. These trailing plates form a means for counteracting a yawing movement during penetration of the fluke and diverge preferably rearwards with respect to one another. As a result, during an initial yawing displacement the correcting striking surface is enlarged and the counteracting striking surface is reduced.

The first lateral areas then enhance the action of the trailing plates in the correction of the yawing movement. They thus form bowl-like areas as it were, as a result of which the pressure that is exerted on the trailing plates by the ground to correct a yawing movement is increased.

According to a further development of the anchor fluke according to the invention, the lower surface of the fluke has a central area that extends upto the trailing edge, wherein said lateral planes extend at least partially until below the trailing edge of the central area. As a result a passage for soil is left clear, causing a favourable initial penetration performance to be obtained. In addition, said trailing plates may bound the earth flow canal in lateral direction. The trailing plates and said planes preferably extend in rearward direction until beyond the trailing edge of at least the central area. Owing to this, the (initial) penetration performance is further enhanced.

BRIEF DESCRIPTION OF THE DRAWINGS

The invention will now be elucidated on the basis of the exemplary embodiment depicted in the enclosed drawings.

The following is shown.

DETAILED DESCRITPION

Figure 1:
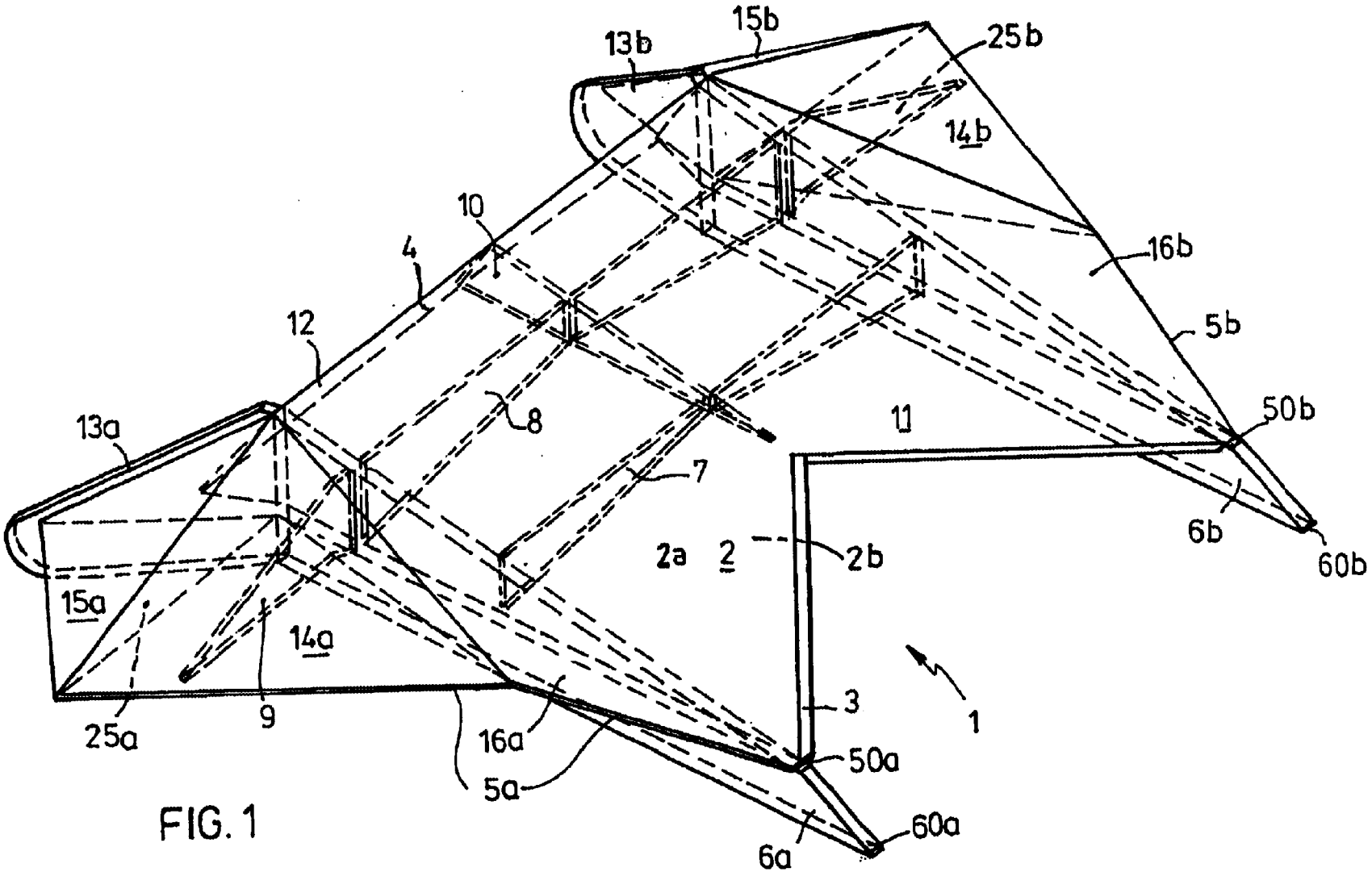
FIG. 1 shows an isometric view of the embodiment of the anchor fluke according to the invention; in cut-away state.

The anchor fluke of FIG. 1 is a so-called hollow fluke that is bounded at the upper side and lower side by upper plate assembly 2*a* and lower plate assembly 2*b*, respectively. Cross girders 7 and 8 and longitudinal girders 6*a* and 6*b* and 10 are located between these two plate assemblies 2*a* and 2*b* . Here, the longitudinal girders 6*a* and 6*b* project from the lower side, but that is not absolutely necessary, and likewise, at the front side with penetration points 60*a* and 60*b* and at the rear side by means of trailing plates 13*a* and 13*b*, which are turned at an angle, diverge with respect to one another and project from the lower side of the fluke.

In order to provide strength at the areas of the anchor fluke 1 lying outside the longitudinal girders 6*a* and 6*b*, the cross girder 8 is prolongated in substantially triangular end cross girders 9*a*, 9*b*, which extend obliquely downwards to the side.

At its front side or penetration side, the anchor fluke 1 is bounded by a V-shaped front edge 3, which ends in points 50*a*, 50*b*, at its rear end by trailing edge 4 and on both sides by side edges 5*a* and 5*b*. The attachment means for the shank of the anchor of which the anchor fluke can be a part, are not depicted.

Figures 2, 7:
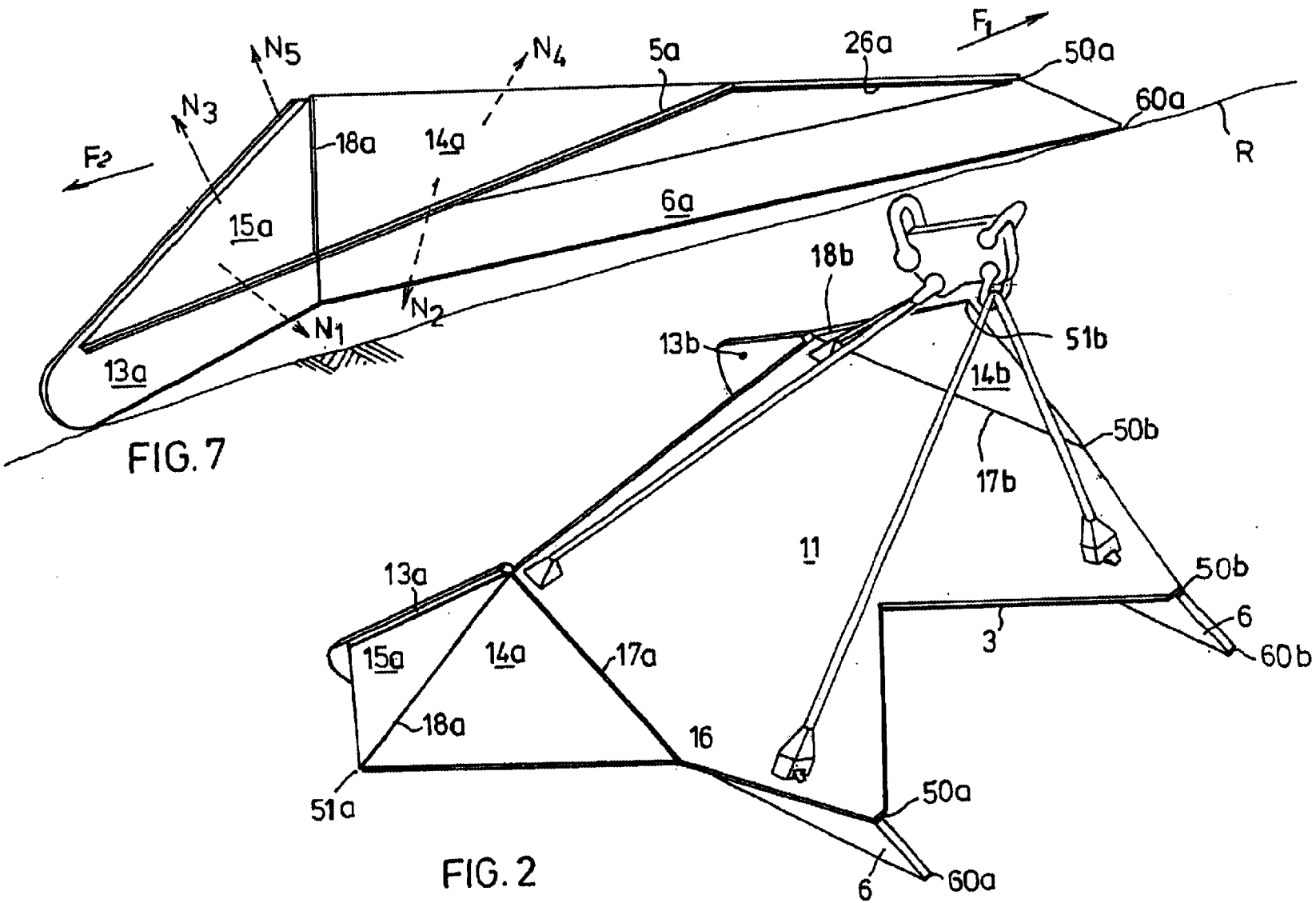
FIG. 2 shows a similar isometric view, in non-cut-away state, however.
FIG. 7 shows a lateral view of the anchor fluke of FIGS. 1 and 2.

Referring now to FIGS. 1 and 2, the upper plate assembly 2*a* of the anchor fluke 1 comprises a center plate 11 and projects laterally beyond the longitundial girdles 6*a* and 6*b* with areas 16*a* and 16*b*. The areas 16*a* and 16*b* bound to second upper side planes 14*a* and 14*b* by means of a buckle-line 17*a*, 17*b*, the normals N4 (see FIG. 7) of the second upper side planes being directed forwards, sidewards and upwards. By means of a buckle-line 18*a*, 18*b* located at the girders 9*a* and 9*b*, in a plane that is perpendicular to the plane perpendicular to the plane of symmetry M (see FIG. 4), the second upper side planes 14*a*, 14*b* merge in turn into first upper side planes 15*a*, 15*b*, the normals N3 (see FIG. 7) of which are directed upwards, sideways and rearwards. At the rear side, the central plane 11 merges into rear upper plane 12*a*, 12*b* (see FIG. 3), the normal N5 (see FIG. 7) of which is directed upwards and rearwards (see FIGS. 3 and 7). The directions bear reference to FIG. 7, among other things, wherein the reference plane R must be seen as being horizontal.

Figure 3:
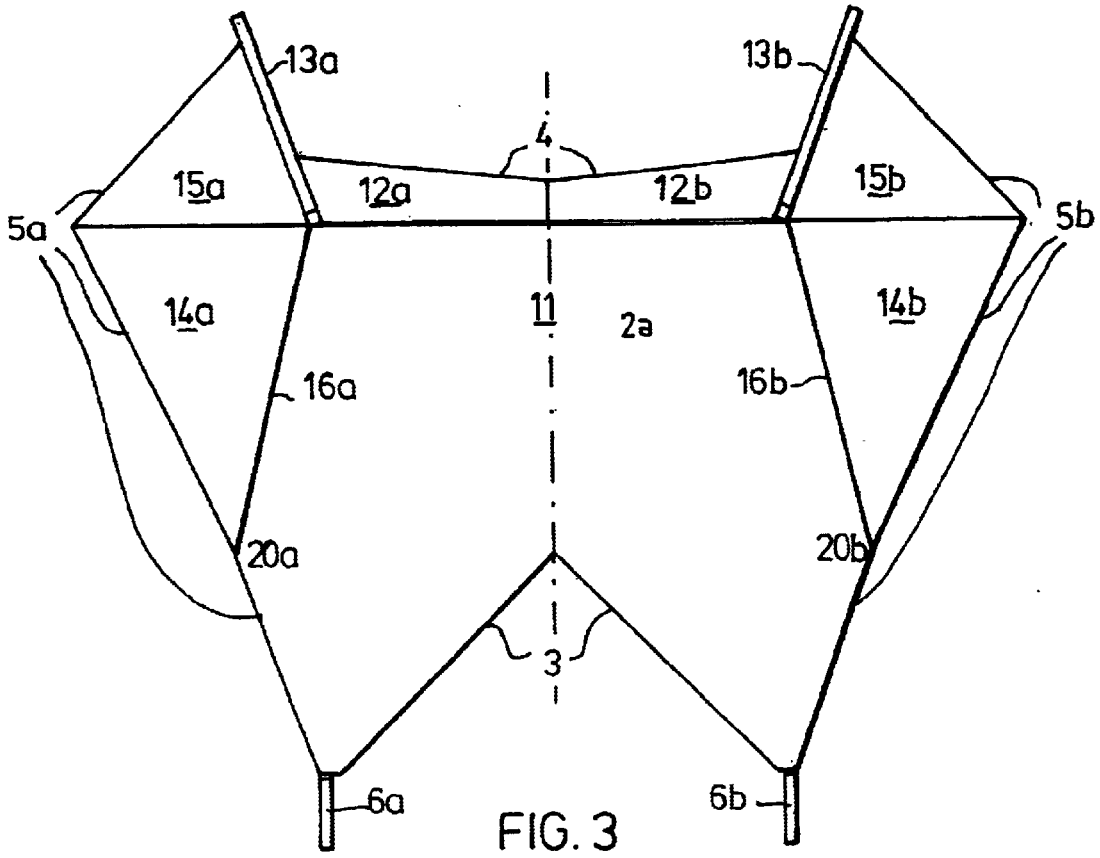
FIG. 3 shows a top view of the anchor fluke of FIGS. 1 and 2.

As can be seen in the top view of FIG. 3, the thus obtained upper surface of the anchor fluke 1 provides a large surface in projection, with which the anchor fluke is particulary suited to be included in vertical anchorage systems as described in the previous international patent applications in the name of the applicant, WO 93/03958 and WO 94/12386. Herein, the second upper side planes 14*a*, 14*b* enhance the rolling and yawing stability of the anchor fluke 1 during forward penetration and orient the fluke in a correct position for vertical anchoring. The first upper side planes 15*a*, 15*b* provide rolling and yawing stability when the fluke is oriented to a position for vertical anchoring. The upper plate assembly 2*a*, comprising areas 11, 16*a*, 14*a*, 14*b*, 15*a*, 15*b*, 12*a*, 12*b*, provides a large efficient surface for vertical anchoring.

Figure 4:
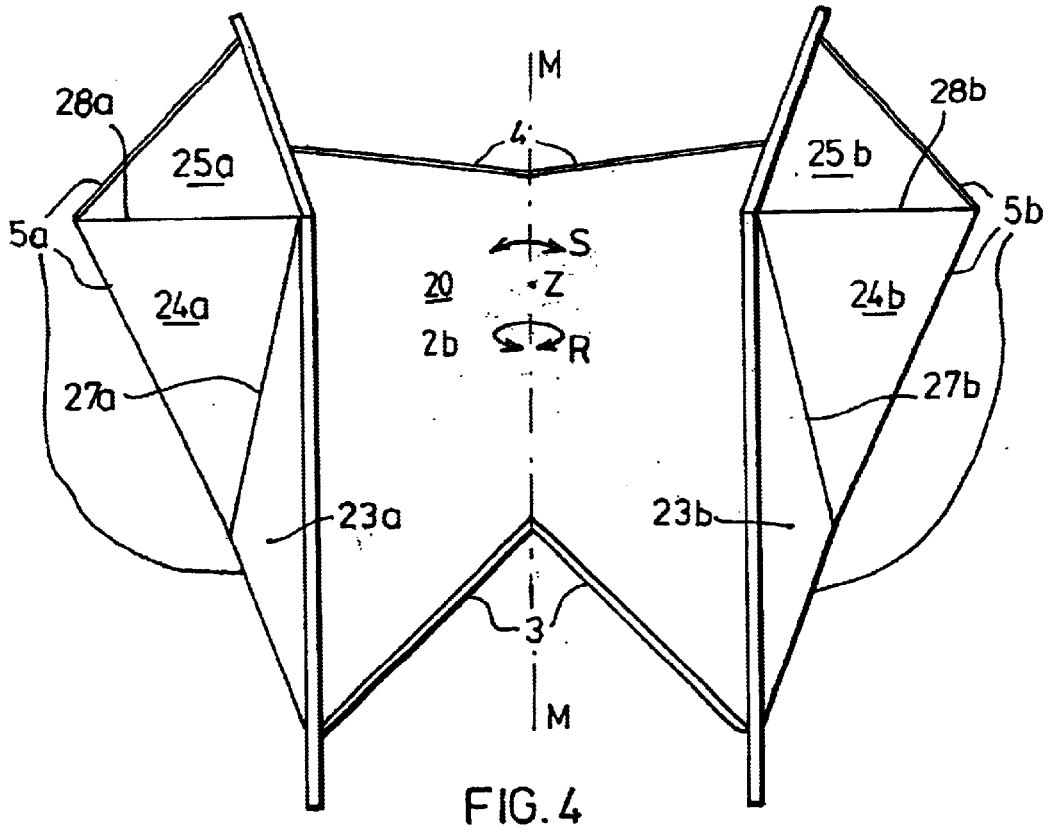
FIG. 4 shows a bottom view of the anchor fluke of FIGS. 1 and 2.
Figure 6:
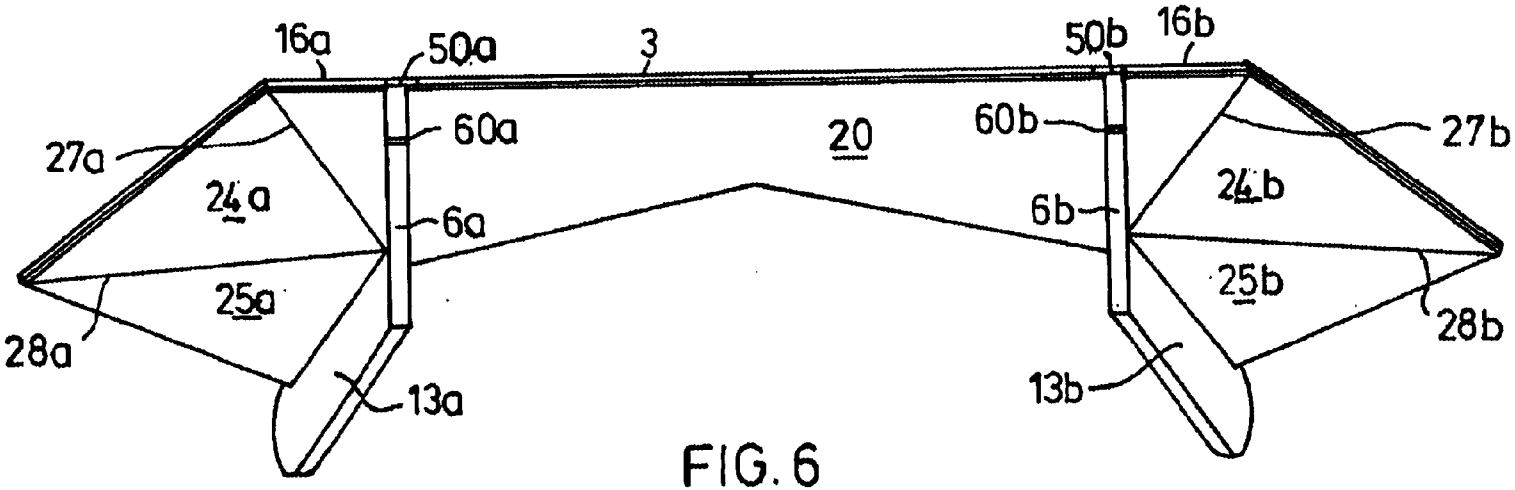
FIG. 6 shows a front view of the anchor fluke of FIGS. 1 and 2 on reference plane R.
Figure 5:
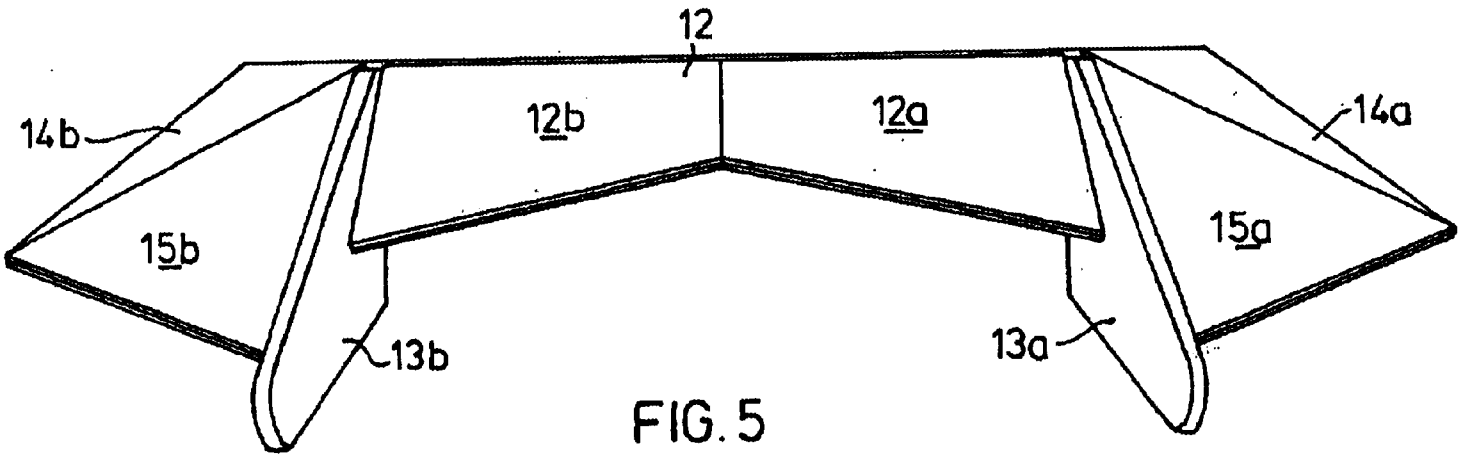
FIG. 5 shows a rear view of the anchor fluke of FIGS. 1 and 2.

Referring now to figures 4, 5, and 6, the lower plate assembly 2*b* consists of a central plate 20 that is located between both longitudinal girders 6*a* and 6*b*. At the outer side of the longitudinal girders 6*a*, 6*b* and 13*a*, 13*b* there are, as seen in the direction from rear to front, first lower side planes 25*a* and 25*b*, the normal N1 (see FIG. 7) of which are each directed obliquely downwards, forwards and inwards and which, by means of buckle-lines 28*a*, 28*b* which lie in one plane with buckle-lines 18*a*, 18*b* between said first and second upper side planes, merges into second lower side planes 24*a* and 24*b*, the normals N2 (see FIG. 7) of which are each directed downwards and somewhat rearwards and inwards. These second lower side panes 24*a*, 24*b* in turn merge into third lower side planes 23*a*, 23*b*, by way of buckle-line 27*a*, 27*b*, the buckle-line 23*a*, 23*b* each lying in one plane with the buckle-lines 17*a*, 17*b* between the upper plane areas 14*a*, 16*a* and 14*b*, 16*b*, which plane is perpendicular to the plane of the drawing of FIG. 4.

In FIGS. 5 and 6 it can be seen that a passage is formed at the lower side of the fluke in the raised central area, which passage is laterally bounded by the longitudinal girders 6*a*, 6*b*, but, in any event, in the rear areas by the trailing plates 13*a* and 13*b*. Owing to this, the relative influence of the areas of the lower side of the fluke located outside of the longitudinal girders 6*a* and 6*b*, is increased, but, in addition, the horizontal setting up of the anchor fluke after penetration for inclusion in a vertical anchorage system is enhanced.

When, after the anchor fluke has penetrated sufficiently, a force is exerted in the direction F2, the planes 12*a* and 12*b* will counteract, yet said planes are limited in size as a result of the tunnel-shape of the area therebelow. Nevertheless, the planes 12*a* and 12*b*, together with the first upper side planes 15*a* and 15*b*, offer a sufficient force component in a direction parallel to F2.

As can be seen in FIGS. 1, 6 and 7, when a pulling force F1 is exerted, ground moving (relatively) past the anchor fluke 1 will butt against the first and second lower side planes 24*a*, 24*b*; 25*a*, 25*b*, and be able to exert a force there on the anchor fluke 1. When the anchor fluke 1 has been tilted about its longitudinal axis as a result of a rolling movement, such that the first lower side plane 25*a* and the second lower side plane 24*a* reach deeper than the lower side planes 25*b*, 24*b*, then said former lower side planes, especially 25*a*, will generate a greater ground force, so that a tilting, correcting moment is exerted onto the fluke. In the case of an oblique position with respect to the direction of the penetration F1 about the center of gravity of the fluke as a result of a yawning movement S (see FIG. 4), the ground will effectively exert a correcting force onto the rear portion of the anchor fluke 1 as a result of the diverging position of the trailing edges 13*a*, 13*b*, so that the orientation is corrected again. The first lower side planes 25*a*, 25*b* participate in this, in that they are oriented to keep the ground more or less near the surface of the active trailing late.

What is claimed is:

1. An anchor fluke, comprising:

a body having an upper and lower surface, a front penetration edge, and a rear trailing edge, the front penetration edge and the rear trailing edge being spaced apart along a longitudinal axis extending through the body, the body having a plane of symmetry that contains the longitudinal axis and is substantially perpendicular to the body, wherein the body includes:

a top plate;

first and second girders arranged parallel to each other and parallel to the plane of symmetry, wherein the first and second girders are coupled to the top plate; and a bottom plate attached to the top plate adjacent the leading edge and attached to side surfaces of the first and second girders to form a generally V-shaped interior chamber between the top plate and the bottom plate, wherein the first and second girders extend past the lower surface;

a mechanism for resisting rotational movement of the body about the longitudinal axis, during penetration of the body in an anchorage ground, the mechanism for resisting rotational movement being spaced from the longitudinal axis and adjacent the lower surface of the body; and a mechanism for resisting yawing movement of the body about an axis that is perpendicular to the longitudinal axis and that is located in the plane of symmetry during penetration of the body in the anchorage ground, the mechanism for resisting yawing including at least one plate extending from the lower surface of the body.

2. The anchor fluke, as set forth in claim 1, wherein the mechanism for resisting yawing movement includes first and second trailing plates extending from the first and second girders rearward.

3. The anchor fluke, as set forth in claim 2, wherein the first and second trailing plates diverge from one another in a direction from the leading edge to the trailing edge of the body.

4. The anchor fluke, as set forth in claim 2, wherein the first and second trailing plates are integrally formed with the first and second girders.

5. The anchor fluke, as set forth in claim 2, wherein the first and second trailing plates extend beyond the trailing edge of the body.

6. The anchor fluke, as set forth in claim 1, wherein the first and second girders extend beyond the leading edge of the body to form penetrating points.

7. An anchor fluke having a hollow body adapted for attachment to a shank and/or anchor lines, wherein the hollow body comprises:

a longitudinal axis;

a front penetration edge and a rear trailing edge which are located at a distance from one another in the direction of the longitudinal axis;

an upper surface at an upper side and a lower surface at a lower side, wherein the upper surface and the lower surface are bounded by the front penetration edge, the rearing trailing edge and lateral edges;

a plane of symmetry including the longitudinal axis and substantially perpendicular to the hollow body;

at least one surface for counteracting a rolling movement about the longitudinal axis during penetration of the anchor fluke in an anchorage ground, wherein the at least one surface for counteracting the rolling movement is located at the lower side substantially between the front penetrating edge, the rear trailing edge, and the lateral edges; and at least one surface for counteracting a yawing movement about an axis that is perpendicular to the longitudinal axis and that is substantially located in the plane of symmetry during penetration in an anchorage ground, wherein the at least one surface for counteracting the yawing movement is located at the lower side substantially between the front penetrating edge, the rear trailing edge, and the lateral edges.

8. The anchor fluke according to claim 7, wherein the at least one surfaces for counteracting the rolling movement include at least one surfaces for receiving a force exerted by the anchorage ground on the lower surface of the anchor fluke spaced from the longitudinal axis.

9. The anchor fluke according to claim 8, wherein the at least one surfaces for counteracting the rolling movement include at least one surfaces for receiving the force exerted by the anchorage ground in a region intermediate the rear trailing edge and a center of gravity of the anchor fluke.

10. The anchor fluke according to claim 7, wherein the at least one surfaces for resisting the rotational movement transmits a first force from the anchorage ground toward the upper surface and the rear trailing edge.

11. The anchor fluke according to claim 10, wherein the at least one surfaces for resisting the rotational movement transmits a second force from the anchorage ground toward the upper surface and the front penetrating edge.

12. The anchor fluke according to claim 7, wherein the upper surface is generally convex and the lower surface is generally concave.

13. The anchor fluke according to claim 7, wherein the at least one surfaces for counteracting the rolling movement are at least partially integral with the lower surface of the anchor fluke.

14. The anchor fluke according to claim 13, wherein the at least one surfaces for counteracting the rolling movement, viewed in longitudinal direction, comprises first lateral areas of the lower surface of the anchor fluke, located substantially beneath the center of gravity of the anchor fluke.

15. The anchor fluke according to claim 14, wherein the at least one surfaces for counteracting the rolling movement, viewed in longitudinal direction, also comprise second lateral areas of the lower surface of the anchor fluke, located in front of the first lateral areas.

16. The anchor fluke according to claim 15, wherein the second lateral areas further comprise second surfaces that face rearwards and downwards.

17. The anchor fluke according to claim 16, wherein the second surfaces face one another.

18. The anchor fluke according to claim 14, wherein the first lateral areas comprise surfaces that face downwards and forwards.

19. The anchor fluke according to claim 13, the hollow body further comprising:

vertical trailing plates located between the first lateral areas and the trailing edge.

20. The anchor fluke according to claim 19, the body further comprising:

a plurality of longitudinal girders of which the vertical trailing plates form an integral part.

21. The anchor fluke according to claim 19, wherein the vertical trailing plates form yaw stabilizers to either side for counteracting the yawing movement and are at least partially integral with the surfaces for counteracting a yawing movement.

22. The anchor fluke according to claim 21, wherein the vertical trailing plates diverge rearwards with respect to one another.

23. The anchor fluke according to claim 19, wherein the lower surface is defined by at least a plurality of intersecting planes, which when viewed in cross direction, connect to the vertical trailing plates and define a hollow area therewith.

24. The anchor fluke according to claim 23, wherein the lower surface of the anchor fluke has a central area that extends up to the trailing edge, wherein the plurality of intersecting planes extend partially below the trailing edge of the central area.

25. The anchor fluke according to claim 24, wherein, when viewed in transverse cross section, the central area is raised in the center to form a soil tunnel.

26. The anchor fluke according to claim 24, wherein the vertical trailing plates together with the central area between the vertical trailing plates define a soil through-flow canal.

27. The anchor fluke according to claim 24, wherein the vertical trailing plates and the plurality of intersecting planes extend in rearward direction beyond the trailing edge of at least the central area.

28. The anchor fluke according to claim 19, wherein the lower surface of the anchor fluke has a central area that extends up to the trailing edge, and wherein the vertical trailing plates together with the central area between the vertical trailing plates define a soil through-flow canal.

29. The anchor fluke according to claim 7, wherein the at least one surfaces for counteracting the rolling movement comprise at least two surfaces that face one another.

30. The anchor fluke according to claim 7, wherein the hollow body is shaped as an upwardly facing V, wherein the at least one surface for counteracting the yawing movement include trailing plates extending downward at the rear trailing edge of the hollow body, the trailing plates being disposed between the lateral edges of the upwardly facing V, and wherein longitudinal girders extend along the lateral edges of the upwardly facing V and project from the upwardly facing V to form penetrating points for the anchor fluke.

31. The anchor fluke according to claim 13, wherein the at least one surfaces for counteracting the rolling movement, viewed in longitudinal direction, further comprise:

first lateral areas of the lower surface of the anchor fluke, located substantially behind the center of gravity of the anchor fluke; and second lateral areas of the lower surface of the anchor fluke, located in front of the first lateral areas, wherein the first lateral area and the second lateral areas face one another.

32. An anchor fluke having a body with a longitudinal axis, wherein the body is adapted for attachment to a shank and/or anchor lines, wherein the anchor fluke has a plane of symmetry including the longitudinal axis and substantially perpendicular to the body, wherein the body comprises:

a front penetration edge and a rear trailing edge which are located at a distance from one another in the direction of the longitudinal axis;

an upper surface and a lower surface, wherein the upper surface and the lower surface are bounded by the front penetration edge, the rearing trailing edge and lateral edges;

a plane of symmetry including the longitudinal axis and substantially perpendicular to either the upper surface, the lower surface, or therebetween;

at least one surfaces for counteracting a rolling movement about the longitudinal axis during penetration of the anchor fluke in an anchorage ground, wherein the surfaces for counteracting the rolling movement are located at the lower side substantially between the front penetrating edge, the rear trailing edge, and the lateral edges; and at least one surfaces for counteracting a yawing movement about an axis that is perpendicular to the longitudinal axis and that is substantially located in the plane of symmetry during penetration in the anchorage ground, wherein the surfaces for counteracting the yawing movement are located at the lower side substantially between the front penetrating edge, the rear trailing edge, and the lateral edges.

33. The anchor fluke according to claim 32, wherein the upper surface is generally convex and the lower surface is generally concave.

34. The anchor fluke according to claim 32, wherein the at least one surfaces for counteracting the rolling movement include means for receiving a force exerted by the anchorage ground on the lower surface of the anchor fluke spaced from the longitudinal axis.

35. The anchor fluke according to claim 34, wherein the at least one surfaces for counteracting rolling movement include means for receiving the force exerted by the anchorage ground in a region intermediate the trailing edge and the center of gravity of the anchor fluke.

36. The anchor fluke, as set forth in claim 32, wherein the at least one surfaces for counteracting rolling movement include at least a first portion of the lower surface of the body.

37. The anchor fluke, as set forth in claim 36, wherein the at least the first portion of the lower surface of the body has a normal line with a directional component extending toward the front penetration edge of the body.

38. The anchor fluke according to claim 32, wherein the at least one surfaces for counteracting rolling movement transmit a first force from the anchorage ground toward the upper surface and the rear trailing edge of the body.

39. The anchor fluke according to claim 38, wherein the at least one surfaces for counteracting rolling movement transmit a second force from the anchorage ground toward the upper surface and the front penetrating edge of the body.

40. The anchor fluke, as set forth in claim 38, wherein the at least one surfaces for counteracting rolling movement include at least a second portion of the lower surface of the body having a normal line with a directional component extending toward the rear trailing edge of the body.

41. The anchor fluke according to claim 32, wherein the body is shaped as an upwardly facing V, wherein the surfaces for counteracting the yawing movement include trailing plates extending downward at the rear trailing edge of the body, the trailing plates being disposed between the lateral edges of the upwardly facing V, and wherein longitudinal girders extend along the lateral edges of the upwardly facing V and project from the upwardly facing V to form penetrating points for the anchor fluke.

42. An anchor fluke, comprising:

a body having an upper and lower surface, a front penetration edge, and a rear trailing edge, the front penetration and rear trailing edges being spaced apart along a longitudinal axis extending through the body, the body having a plane of symmetry that contains the longitudinal axis and is substantially perpendicular to the body;

a mechanism for resisting rotational movement of the body about the longitudinal axis, during penetration of the body in an anchorage ground, the mechanism for resisting rotational movement being spaced from the longitudinal axis and adjacent the lower surface of the body; and a mechanism for resisting yawing movement of the body about an axis that is perpendicular to the longitudinal axis and that is located in the plane of symmetry during penetration of the body in the anchorage ground, the mechanism for resisting yawing including at least one plate extending downward from the lower surface of the body.

43. The anchor fluke, as set forth in claim 42, wherein the mechanism for resisting rotational movement includes at least a first portion of the lower surface of the body.

44. The anchor fluke, as set forth in claim 43, wherein the at least the first portion of the lower surface of the body has a normal line with a directional component extending toward the front penetration edge of the body.

45. The anchor fluke, as set forth in claim 43, wherein the mechanism for resisting rotation movement includes at least a second portion of the lower surface of the body having a normal line with a directional component extending toward the rear trailing edge of the body.

46. The anchor fluke according to claim 42, wherein the mechanism for resisting rotation movement includes means for receiving a force exerted by the anchorage ground on the lower surface of the anchor fluke spaced from the longitudinal axis.

47. The anchor fluke according to claim 46, wherein the mechanism for resisting rotation movement includes means for receiving the force exerted by the anchorage ground in a region intermediate the rear trailing edge and a center of gravity of the anchor fluke.

48. The anchor fluke according to claim 42, wherein the mechanism for resisting rotation movement transmits a first force from the anchorage ground toward the top surface and the rear trailing edge.

49. The anchor fluke according to claim 48, wherein the mechanism for resisting rotation movement transmits a second force from the anchorage ground toward the top surface and the front penetrating edge of the body.

* * * * *